US006082932A

United States Patent [19]

Anderson

[11] Patent Number: 6,082,932

[45] Date of Patent: Jul. 4, 2000

[54] FOUNDATION SOIL MOISTURE STABILIZATION SYSTEM

[76] Inventor: Gary L. Anderson, 1118 Cheshire La., Houston, Tex. 77018

[21] Appl. No.: 08/909,292

[22] Filed: Aug. 11, 1997

[51] Int. Cl.[7] ..... E02B 11/00; E02D 31/00

[52] U.S. Cl. ..... 405/229; 405/36; 405/52; 52/169.5

[58] Field of Search ..... 405/229, 230, 405/36, 37, 43, 51; 52/169.5, 169.14; 239/63

[56] References Cited

U.S. PATENT DOCUMENTS

| | | | |
|---|---|---|---|
| 3,046,747 | 7/1962 | Timpe | 405/45 |
| 3,182,914 | 5/1965 | Hosier | 239/63 X |
| 3,844,305 | 10/1974 | McCormick | 239/63 X |
| 4,194,691 | 3/1980 | Birnbach et al. | 239/63 |
| 4,534,143 | 8/1985 | Goines et al. | 405/45 X |
| 4,648,555 | 3/1987 | Gumbmann | 239/63 |
| 4,684,920 | 8/1987 | Reiter | 239/63 X |
| 4,878,781 | 11/1989 | Gregory et al. | 405/36 X |
| 4,879,852 | 11/1989 | Tripp | 405/37 X |
| 4,995,764 | 2/1991 | Connery et al. | 405/229 |
| 5,156,494 | 10/1992 | Owens et al. | 405/229 |
| 5,341,831 | 8/1994 | Zur | 239/63 X |
| 5,348,227 | 9/1994 | Polonsky | 239/63 |
| 5,642,967 | 7/1997 | Swain et al. | 405/229 |

*Primary Examiner*—Dennis L. Taylor
*Attorney, Agent, or Firm*—Bill B. Berryhill

[57] ABSTRACT

A system for stabilizing moisture content of soil around and beneath the foundation of a building. The system includes a source of pressurized water; one or more conduits buried in the soil around the building foundation, at least a portion of soil conduit being pervious to water, allowing water therein to enter said soil; and a remotely operated valve connecting the source of water to the conduits to permit or prevent flow of water, respectively, from the source of water to the conduits. A controller is operatively connected to the remotely operated valve for transmitting signals to the valve for opening and closing thereof in a predetermined time cycle. At least one soil moisture sensitive device is operatively connected to the controller and/or the valve for interrupting signals transmitted to the valve, to prevent opening of the valve when the moisture content of the soil exceeds a predetermined amount.

7 Claims, 3 Drawing Sheets

FOUNDATION SOIL MOISTURE STABILIZATION SYSTEM

BACKGROUND OF THE INVENTION

1. Field of the Invention

The present invention pertains to systems for controlling and stabilizing the moisture content of soil around and beneath the foundation of a building. More specifically, the present invention pertains to an improved soil moisture stabilization system by which water flows to or is prevented from flowing to soil around and beneath the foundation of a building, depending upon measured moisture content thereof.

2. Description of the Prior Art

Soils expand and contract to a degree relating to the moisture content therein. Certain types of soil, such as the clay soils of the Gulf Coast, are highly expansive. For example, one dry cubic foot of Beaumont/Lake Charles clay soil can expand up to four cubic feet with the addition of moisture thereto. One can readily see that buildings may be damaged by such expansion and contraction of the soils surrounding and beneath the foundation. Repeated wetting and drying of the soil, particularly when done unevenly, can place great stress on foundations resulting in tilting, cracking and destruction of the foundation. This, of course, often results in damage to structures supported on such foundations.

Several years ago, systems began to be developed for stabilizing the moisture content of soil around and beneath the foundations of buildings. These early systems were nothing more than simple soaker hose, drip irrigation systems controlled by an individual on an as-needed/as-remembered basis. Small soaker hose was laid on the ground, across sidewalks and up to driveways, patios, pool aprons, and other obstructions which covered part of the support soil around and under a building. Although such systems may have helped in some cases, they were very inefficient due to lack of uniform distribution of water and the lack of access to soil under driveways, sidewalks and the building foundation itself. The, soaker hoses utilized with such systems do not evenly distribute moisture without proper flow and pressure controls. Neither are they capable of distributing the volume of water necessary to correct the supporting soils' loss of moisture. These hoses are manufactured to operate at very low operating pressures and at low flow rates, typically one quarter gallon per minute. The low operating pressures allow relatively large flow of water near the point of entry but with volume severely diminished in a short distance. The hose frequently clogs up due to low operating pressure. Intrusion of insects, such as ants, typically create problems with such systems.

As previously mentioned, the conventional soaker hose/drip system was not buried or placed under concrete. This eliminated water flow to many areas since most buildings have some form of concrete attached to the foundation, e.g., driveways, sidewalks, patios, porches, etc. To attain and maintain uniform support around a foundation a properly designed/engineered moisture delivery system should be able to distribute water under such concrete areas. In fact, such a system should have the capability of delivering water to the soil underneath the foundation supported thereon. More recently, simple irrigation timers and/or controllers have been added to foundation watering systems. Although this does improve the distribution of water, such systems also have limitations. The controller can only control the number of times or length of time that a zone or irrigation section will be watered. It will not determine the moisture content of the soil being watered. Although such controllers can be pre-programmed for watering cycles of predetermined length or duration and times between cycles, they often result in overwatering of the supporting soil and cannot compensate for variable moisture content in separate zones or areas of the soil around and beneath the foundation of a building. If the soil is overwatered, it can cause severe problems. The soil may actually be liquified, totally destroying its supporting ability. Overwatering can also cause subterranean erosion in which support soil is actually washed away.

Thus, prior art systems for stabilizing moisture content of soil around and beneath the foundation of a building leave much to be desired. Although they may operate with limited success, the prior art systems are not uniformly effective and efficient. Substantial improvements thereto are needed.

SUMMARY OF THE PRESENT INVENTION

The system of the present invention provides a well controlled system for stabilizing moisture content of soil around and beneath the foundation of a building. The system, of course, includes a source of pressurized water connected to one or more conduits buried in the soil around and beneath the foundation of a building. At least a portion of each conduit is pervious to water, allowing water therein to enter the surrounding soil. In preferred embodiments, the conduits comprise alternate sections of hose and pipe which are pervious and impervious, respectively, to water. One or more remotely operated valves control the flow of pressurized water to the conduits. A controller is operatively connected to the remotely operated valve or valves and includes a timer by which signals are transmitted to the valve for opening and closing thereof in a predetermined time cycle. The system also comprises at least one moisture sensitive device, a portion of which is buried in the soil around the foundation for determining the moisture content thereof. The moisture sensitive device is operatively connected to the controller and/or the valve or valves for interrupting signals transmitted to the valves, preventing opening of the valves when the moisture content of the soil exceeds a predetermined amount.

Thus, the system of the present invention, more accurately controls the moisture content of soil surrounding and beneath the foundation of a building. Water is periodically administered to the soil and the soil is constantly checked for moisture content. When the moisture content exceeds a predetermined amount, signals to open the valve for watering thereof are interrupted, preventing overwatering of the soil and the associated problems of overwatering. In addition, the type of conduits utilized with the present invention allow conduits to be placed in horizontal holes provided therefor directly underneath sidewalks, patios, porches, and the foundation itself, resulting in much more even distribution of water thereto. Thus, the soil surrounding and beneath the foundation of a building is substantially moisture stabilized, preventing stress and damage to the foundation and the supported structure. Many other objects and advantages of the invention will be apparent from reading the description which follows in conjunction with the accompanying drawings.

DESCRIPTION OF A PREFERRED EMBODIMENT OF THE INVENTION

Figure 1:
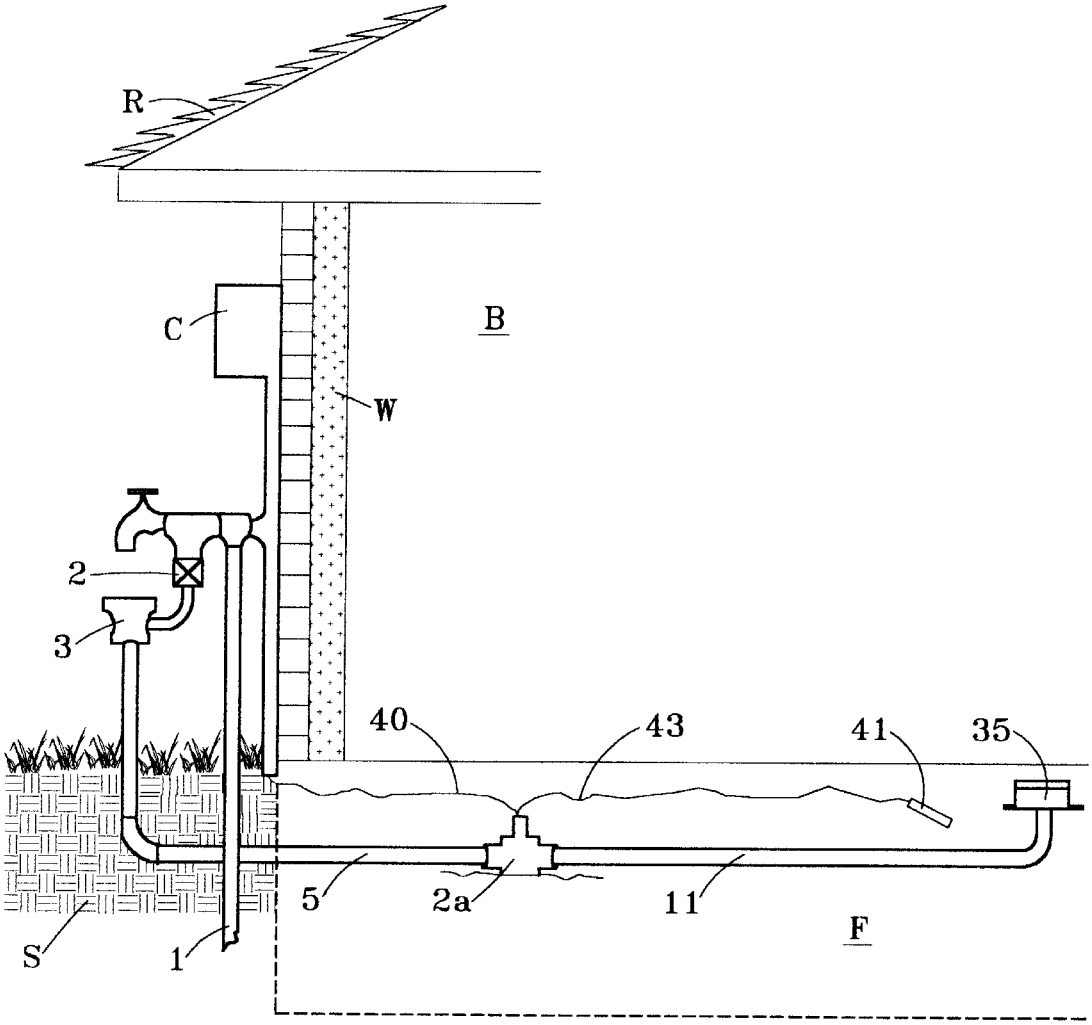
FIG. 1 is an elevation view, partially in section, of a building, its foundation, and soil surrounding the building, illustrating a portion of the moisture stabilizing system of the present invention, according to a preferred embodiment thereof.

Referring first to FIG. 1, there is shown a building B supported on a foundation F surrounding and beneath which is supporting soil S. The building includes a wall structure W and a supported roof structure R. The building B, for example a house, may have a water pipe 1 from which a source of pressurized water (such as city water) is supplied to the building B. As illustrated in FIG. 1, the water supply pipe 1 is connected through a master valve 2 and a pressure vacuum breaker/back flow preventer 3 to one or more conduits such as the conduits 10, 11, 20, 21, of FIG. 2.

Figure 2:
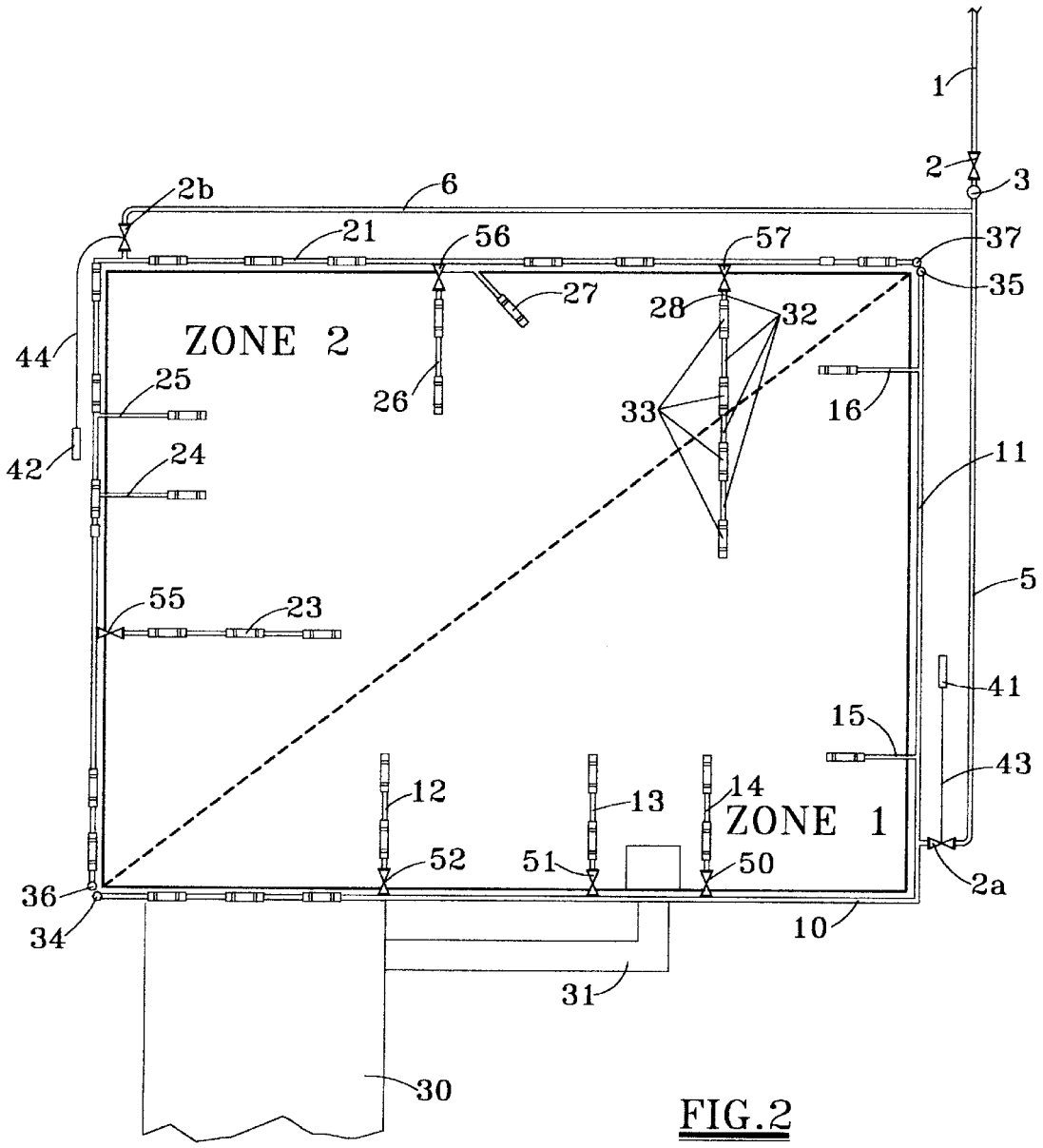
FIG. 2 is a schematic plan view of the moisture stabilizing system of the present invention, according to a preferred embodiment thereof.

Referring also to FIG. 2, a number of conduits may be supplied from the source of pressurized water in pipe 1 through master valve 2. In FIG. 2, the conduits are actually arranged together in two separate zones or systems, Zone 1 and Zone 2. As best seen in FIG. 2, the conduits lie around the foundation F of the building and in some cases are actually buried beneath the foundation. For example the conduits of Zone 1 include conduits 10 and 11 lying along the sides of the foundation and conduits 12, 13, 14, 15, and 16 beneath the foundation. The conduits of Zone 2 include conduits 20 and 21 along sides of the foundation F and conduits 23, 24, 25, 26, 27, and 28 beneath the foundation F. It will also be noted that some of the conduits must pass underneath a driveway 30 and sidewalk 31. The conduits of Zone 1 and Zone 2 are supplied through remotely operated valves 2*a* and 2*b* connected by piping 5, 6 to master valve 2 and pressure vacuum breaker/back flow preventer 3.

The conduits beneath the foundation F and other concrete members such as the driveway 30 and sidewalk 31 may be placed by first drilling a horizontal hole thereunder. The diameter of the hole is slightly larger than the largest diameter of these conduits. This allows the conduit to be pushed into place. In preferred embodiments of the invention, the conduits are made up of alternating sections of water impervious pipe such as PVC and sections of rubber soaker hose which is pervious to water. For example, conduit 28 has four sections of non-pervious PVC pipe 32 and four sections of water-pervious hose 33.

The ends of conduits 10 and 11 may be provided with flush ports 34, 35 and conduits 20 and 21 with flush ports 36, 37. This allows the conduits to be back flushed by connection of a source of pressurized water thereto. As previously indicated, there is at least one remotely operated valves 2*a*, 2*b* provided for each zone. In addition to the remotely operated valves 2*a*, 2*b*, a number of manually operated valves 50, 51, 52, 55, 56, 57 may be provided. The valves 2*a*, 2*b* are remotely operated valves which are connected by wiring, such as wiring 40 in FIG. 1, to a controller C. The controller C and its operation will be more fully discussed hereafter.

At least one moisture sensor 41, 42 is provided for each zone. The moisture sensor 41 is buried in the soil S and connected by wiring 43, 44 to an associated solenoid or remotely operated valve 2*a*. The moisture sensitive devices or tensiometer 41, 42 comprise a sensing element or module for sensing the moisture content of soil and an adjustable control element or module in which circuitry is provided for interfacing with an associated remotely operated valve 2*a*, 2*b*. The tensiometer is of a design described in U.S. Pat. No. 4,488,568 and includes a heat diffusion sensor or thermistor, the electrical resistance of which varies as a function of the rate of heat loss which depends upon the moisture content of the soil in which the tensiometer is buried. The sensing element is characterized as having relatively low electrical resistance when cooled by water and relatively high electrical resistance when dry. If low ohmage resistance of a selected value is wired in series with the sensing element, the voltage across the resistor will be high when the sensor is wet and low when the sensor is dry. This voltage change can be used to trigger a solid state switch to allow current to flow through a relay coil to actuate relay contacts open, removing power from the valves 2*a*, 2*b* when the moisture content in the soil exceeds a predetermined amount. Thus, even though a signal may be sent from the Controller C to open valves 2*a*, 2*b* the signal will be interrupted by the tensiometer 41 when the moisture content in the soil exceeds a certain amount. This prevents the valve 2*a*, 2*b* from opening and prevents overwatering of the soil.

Figure 3:
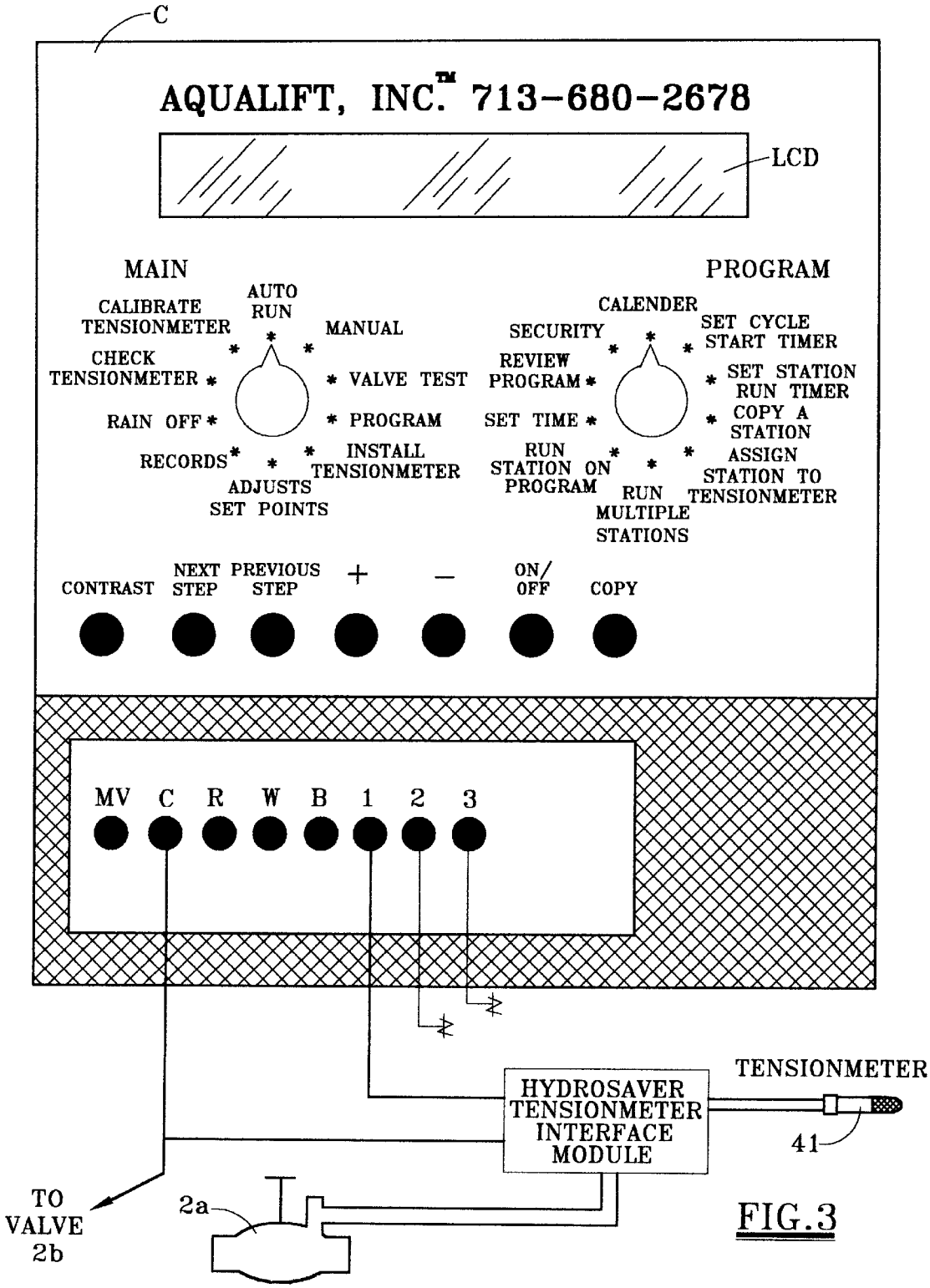
FIG. 3 is a schematic representation of a controller, a remotely operated valve and a moisture sensitive device which are components of the soil moisture stabilizing system of the present invention, according to a preferred embodiment thereof.

Referring now to FIG. 3, the controller C is shown connected to a remotely operable valve such as the valve 2*a* of FIGS. 1 and 2 and a moisture sensor such as the moisture sensor 41 of FIG. 1. The controller C comprises a housing enclosed microprocessor which is controlled and programmed through a main dial and a program dial. The main dial has ten positions. These positions and their functions are:

1. Auto Run—normal running position
2. Manual—runs a station, rain or phase, security turnoff.
3. Valve Test, runs all stations, programmed syringed cycle.
4. Programming—accessing programming functions
5. Install Tensiometer—auto detection, installation and grouping of tensiometers.
6. Adjust Set Points—adjust tensiometer set points.
7. Records—one weeks tensiometer readings.
8. Rain Off—runs no cycles.
9. Check Tensiometer—run a sensing cycle.
10. Calibrate Tensiometer—adjust tensiometer calibration.

The programming dial has the following ten positions and functions:

1. Calendar—days to run.
2. Set Cycle Start Time—how many cycles and when they start.
3. Set Station Run Timer—how long each station runs.
4. Copy A Station—copy one stations run time to another.
5. Assign Station To Tensiometer.
6. Run Multiple Stations—run more than one station at a time.
7. Run Station On Program.
8. Set Time—sets the time.
9. Review Program—review calendar, cycles and stations.
10. Security—security code.

Six push buttons are provided with the following functions: contrast, next step, previous step, plus, minus, on/off, and copy. An LCD readout provides visual observation.

In the embodiment of FIG. 3, there are eight output terminals labeled MV, C, R, W, B, 1, 2, 3. The C terminal is connected to a common wire which is connected, through control or the interface module of tensiometer 41, to remotely operable valve 2*a* and other valves such as remotely operable valve 2*b*. Terminal 1 is also connected to the interface module. Terminals 2 and 3 may be connected to interface modules of other remotely operable valves, such as 2*b*.

When connected and in operation the controller C is set and programmed to open valves 2*a* and 2*b* in cycles of predetermined time and duration. The times and duration for each remotely operated valve 2*a*, 2*b*, etc. may be changed by settings of the programming dial after setting the main dial on its programming position (position 4).

The tensiometer such as 41, 42, may be adjusted and set for particular moisture settings by setting of the main dial. The tensiometer may be calibrated, reset and tested by setting of the main dial.

Once the valves 2*a*, 2*b*, etc. are programmed, they will open at the predetermined times, allowing water to flow through conduits in their associated zones, watering the soil therearound. If the soil has reached a predetermined content of water, as sensed by the sensing elements of tensiometer 41, 42, this interface or control module of the tensiometer, will interrupt signals to the associated valve 2*a*, 2*b*, etc. preventing opening of the valve. If in the next or subsequent cycles, the moisture has decreased below the predetermined level, the signal will no longer be interrupted, allowing the valve to open for flow of water to conduits of its associated zone and the soil therearound.

Thus, the system of the present invention comprises a source of water and one or more conduits, at least partially pervious to water, buried in the soil around and/or under the foundation of a building. One or more remotely operated valves connect the conduits to the source of water. The valves are operatively connected to a controller, which includes a timer, and which transmits signals to open the remotely operated valves in predetermined time and duration cycles. At least one moisture sensitive device or tensiometer, a portion of which is buried in the soil, is operatively interfaced with the valves to prevent their opening if the moisture control of the soil exceeds a predetermined amount.

The soil is therefore watered, but not overwatered, to stabilize the moisture content of soil around and beneath the foundation. This prevents damage to the foundation and structure supported thereby.

A single embodiment of the invention has been described herein. Although the embodiment is obviously capable of a number of functions, many variations will be apparent to those skilled in the art. Accordingly, it is intended that the scope of the invention be limited only by the claims which follow.

I claim:

1. A system for stabilizing moisture content of soil around and beneath the foundation of a building comprising:

a source of pressurized water;

one or more conduits buried in said soil around the foundation of said building, at least a portion of said conduits being pervious to water, allowing water therein to enter said soil;

a remotely operated valve connecting said pressurized source of water to said one or more conduits and remotely movable between opened and closed positions to permit and prevent flow of water, respectively, from said source of water to said one or more conduits;

a controller operatively connected to said remotely operated valve, said controller including a timer and a microprocessor by which signals are transmitted to said valve for remotely opening and closing thereof in a predetermined time and duration cycle; and at least one moisture sensitive device, a portion of which is buried in the soil around said foundation for determining the moisture content thereof, said moisture sensitive device being operatively connected to at least one of said controller and said valve for interrupting said signals transmitted to said valve, to prevent opening of said valve when the moisture content of said soil exceeds a predetermined amount.

2. The soil moisture stabilizing system of claim 1 in which said moisture sensitive device comprises a sensing element for sensing the moisture content of said soil and a control element by which said signals transmitted to said valve may be interrupted.

3. The soil moisture stabilizing system of claim 2 in which said control element is adjustable so that the level of moisture in said soil necessary to cause interruption of said signal may be adjusted as desired.

4. The soil moisture stabilizing system of claim 3 in which said control element is operatively connected to said controller, said control element being remotely adjustable from said controller.

5. The soil moisture stabilizing system as set forth in claim 4 in which said controller is provided with means for overriding said control element so that said signals transmitted to said valve may not be interrupted thereby.

6. The soil moisture stabilization system of claim 1 in which said conduits comprise alternating sections of impervious material and sections of water pervious material.

7. The soil moisture stabilizing system as set forth in claim 6 one or more of said conduits of alternating sections is placed in a hole horizontally drilled in the soil beneath said foundation.

* * * * *